US006019532A

United States Patent [19]

Harris et al.

[11] Patent Number: 6,019,532

[45] Date of Patent: Feb. 1, 2000

[54] PRINTER HAVING A PAPER OUT/COVER OPEN SENSOR AND METHOD THEREFOR

[75] Inventors: Richard Hunter Harris, Raleigh; Ronald Gary King, Apex, both of N.C.

[73] Assignee: International Business Machines Corporation, Armonk, N.Y.

[21] Appl. No.: 09/097,451

[22] Filed: Jun. 15, 1998

Related U.S. Application Data

[63] Continuation of application No. 08/919,910, Aug. 28, 1997, Pat. No. 5,823,696.

[51] Int. Cl.[7] ..... B41J 29/18

[52] U.S. Cl. ..... 400/708; 400/708.1; 400/707.1

[58] Field of Search ..... 400/596, 703, 400/708, 707.1, 706, 708.1; 347/108, 109

[56] References Cited

U.S. PATENT DOCUMENTS

| | | | |
|---|---|---|---|
| 2,693,510 | 11/1954 | Luebking et al. | 200/16 C |
| 4,111,565 | 9/1978 | Jagger | 400/708 |
| 4,674,895 | 6/1987 | Tanaka et al. | 400/121 |
| 5,264,864 | 11/1993 | Hollman et al. | 346/1.1 |
| 5,396,396 | 3/1995 | Watanabe | 361/212 |
| 5,570,962 | 11/1996 | Suzuki et al. | 400/120.16 |
| 5,640,182 | 6/1997 | Bahrami et al. | 347/33 |
| 5,676,475 | 10/1997 | Dull | 400/174 |

FOREIGN PATENT DOCUMENTS 42 17 831 A1 12/1992 Germany .

*Primary Examiner*—Ren Yan
*Assistant Examiner*—Dave A Ghatt
*Attorney, Agent, or Firm*—John D. Flynn; Winstead, Minnick & Sechrest

[57] ABSTRACT

A printer has a control circuit to stop a print head from printing when paper runs out or when the cover of the printer is opened is disclosed. Only one switch is used to detect the absence of paper and the position of the cover.

22 Claims, 2 Drawing Sheets

PRINTER HAVING A PAPER OUT/COVER OPEN SENSOR AND METHOD THEREFOR

This is a continuation of application Ser. No. 08/919,910 filed Aug. 28, 1997 now U.S. Pat. No. 5,823,696.

TECHNICAL FIELD

This invention relates in general to printers that have a logic circuit controlled by a switch, and in particular to printers having logic switches used to determine the presence or absence of paper and the position of the printer's cover.

BACKGROUND INFORMATION

Printers are currently found in many forms, however all printers share common characteristics such as a print head, a platen and a control mechanism. The control mechanism controls the motion of the print head relative to the paper, selects a character to be printed, and advances and retracts the paper as necessary.

It is undesirable for a printer to operate without paper. Ink-based printers that are operated without paper will transfer the ink into the platen which may in turn stain the back sides of subsequent sheets of paper and possibly damage print writes in the print head. Thermal printers operated without paper may overheat without paper present to absorb the heat generated by the print head. Also, any printer that operates without paper will cause frustration when documents must be reprinted. Most modern printers, therefore, include a control mechanism to stop the printer if paper runs out and to prevent the printer from starting to print unless an adequate paper supply is present. This control mechanism typically includes a limit or proximity switch to detect the presence or absence of paper.

For example, the apparatus disclosed in U.S. Pat. No. 4,111,565 includes a switch associated with a pivotal sensing member which provides an indication to control circuitry that no paper is present for printing. Not disclosed however, is any apparatus to indicate whether the printer's case is open.

In U.S. Pat. No. 5,396,396 an apparatus is disclosed to indicate opened and closed positions of a cover. Not disclosed, however, is any means of indicating the presence or absence of paper for printing.

Most modern printers are enclosed in covers or cases with hinged or removable sections that open for access to the printing and mechanical areas. These printers are not designed to be operated with the cover open, as the internal mechanism may be at high temperature or include numerous moving parts. This is especially true in the case of a thermal printer where the print head can be damaged if the print head is driven when the cover is open and the print head is not against the platen and nothing is present to absorb heat from the print head. Therefore, these printers typically include an interlock that will prevent the printer from operating with the cover open. The usual interlock includes a limit or proximity switch used to detect whether the printer is open or closed.

The control switches used to detect paper and determine whether the printer is open must be durable and capable of handling a large number of cycles without failure, as failure of these switches can result in damage to the printer or injury to the operator. As a result, the switches used for these tasks are usually expensive. The use of separate switches for these tasks adds substantial expense to the cost of the printer because of associated hardware costs. What is needed, therefore, is a simple, cost-effective method to detect the presence of paper and to determine cover position without duplicating components and increasing the manufacturing costs of the printer.

SUMMARY OF THE INVENTION

The previously mentioned needs are fulfilled with the present invention. Accordingly, there is provided, in a first form, a printer having a body, a paper path within the body for routing paper and a gap along the paper path covered by paper present in the paper path, a cover, and a switch attached to the cover, with the switch having an arm that moves into the gap if paper is absent from the paper path or that moves into the space created between the body and the cover as the cover is opened.

These and other features, and advantages, will be more clearly understood from the following detailed description taken in conjunction with the accompanying drawings. It is important to note the drawings are not intended to represent the only form of the invention.

BRIEF DESCRIPTION OF THE DRAWINGS

For a more complete understanding of the present invention, and the advantages thereof, reference is now made to the following descriptions taken in conjunction with the accompanying drawings, in which.

For a more complete understanding of the present invention, and the advantages thereof, reference is now made to the following descriptions taken in conjunction with the accompanying drawings, in which.

DETAILED DESCRIPTION

Figure 1:
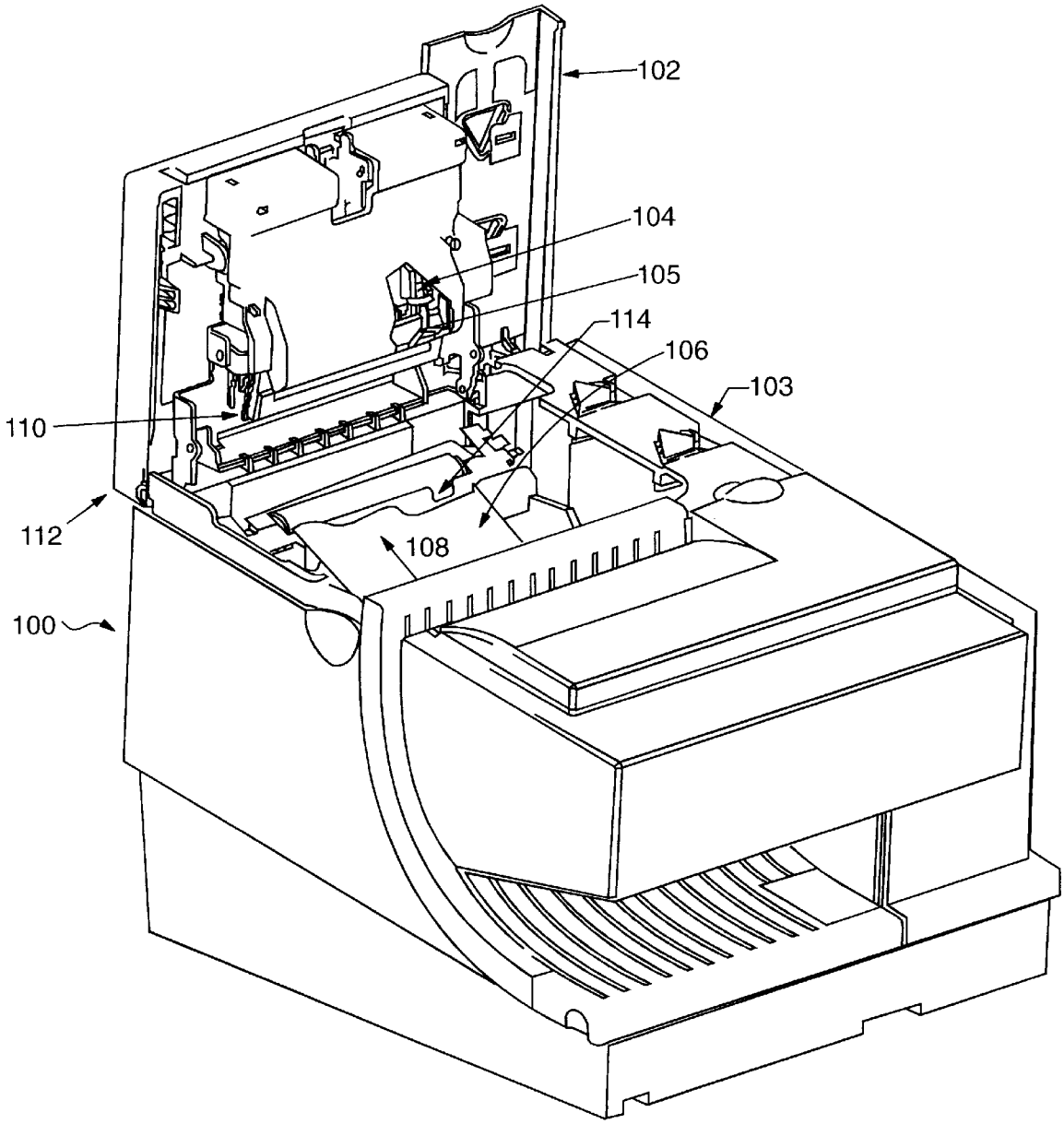
FIG. 1 is a perspective view of a printer implemented in accordance with one embodiment of the present invention.
Figure 2:
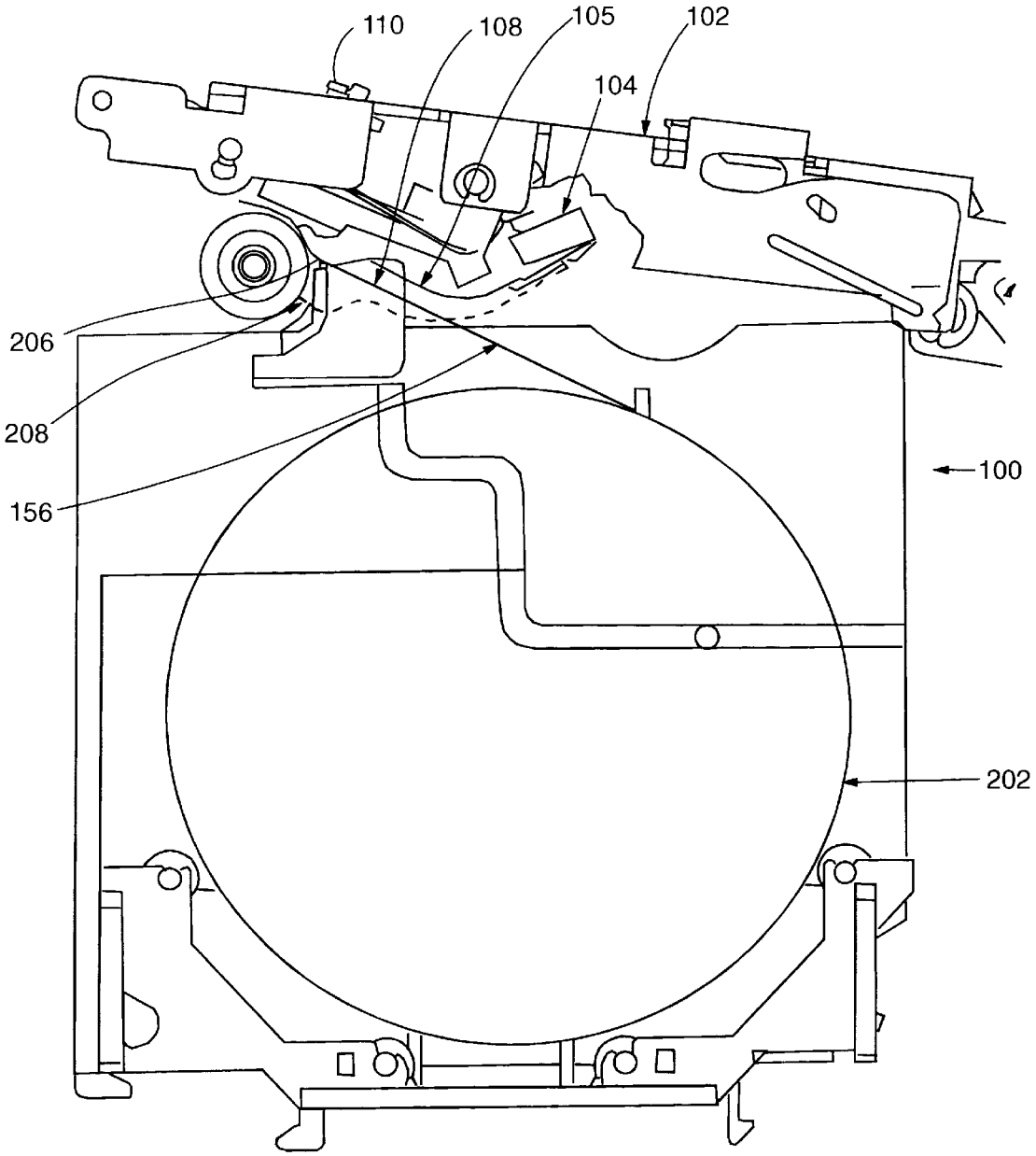
FIG. 2 is an internal view of the printer of FIG. 1, illustrating a paper path, a cover and a combination paper out/cover open switch.

The principles of the present invention and their advantages are best understood by referring to one illustrated embodiment of the present invention depicted in FIGS. 1–2 of the drawings, in which like numbers designate like parts. In the following description, well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art. Details regarding control circuitry or mechanisms used to control the printing operation or paper feeding through the printer are omitted, as such control circuits are within the skills of persons of ordinary skill in the relevant art.

Referring now to FIG. 1, a perspective view of a printer 100 incorporating one embodiment of the present invention is illustrated. Printer 100 has a cover 102 connected to a printer body 103. Cover 102 has an open position and a closed position. In one embodiment of the present invention, cover 102 must be in the closed position for printer 100 to operate. In FIG. 1, cover 102 is shown in the open position. Paper 106 is shown along paper path 108. During printing, paper 106 may be advanced and retracted along paper path 108 by well-known means, or alternatively, in accordance with the subject matter of the co-pending and commonly owned patent applications: (1) Ser. No. 08/781,771, now U.S. Pat. No. 5,865,547, entitled "Check Flipper for Point of Sale Printer and Method Therefor" by Richard H. Harris, et al., filed Jan. 10, 1997; (2) Ser. No. 08/781,770, now U.S. Pat. No. 5,813,781 entitled "A Document Feed Roller Opener and Method Therefor" by Richard H. Harris, et al., filed Jan. 10, 1997; and (3) Ser. No. 08/842,617, now U.S. Pat. No. 5,795,087 entitled "Pivoting Roller for Skewless Document Feed" by David C. Brower and Robert A. Myers, which are hereby incorporated by reference herein.

Print head 110 is carried by cover 102. Cover 102 may be attached to printer body 103 by hinges 112. Alternatively, cover 102 may be detachable from printer body 103. Attached to the underside of cover 102 is a switch 104. Switch 104 has an arm 105. A gap 114 is illustrated along paper path 108. Gap 114 is covered by paper 106 as paper 106 passes along paper path 108.

Turning now to FIG. 2, an internal view of printer 100 is illustrated. A quantity of paper 106 is shown coiled into paper roll 202. Only the outline of paper roll 202 is depicted, with the interior area of paper roll 202 not shown in order to show additional structure of printer 100. In this embodiment, characters are printed onto paper 106 by print head 110 as paper 106 is unrolled from paper roll 202. It should be noted that the disclosed invention is also adaptable for use in single-sheet printers. Paper 106 is driven across print head 110 by well known means, as is the control circuitry or mechanism used to control the motion of paper 106 across print head 110.

Attached to cover 102 is switch 104. A portion of cover 102 has been removed in FIG. 2 for purposes of illustrating one embodiment of a mounting position of switch 104 in one embodiment of the present invention. Switch 104 comprises body 204 and arm 105, wherein arm 105 has an upper position 206 and a lower position 208. In FIG. 2, arm 105 is shown in upper position 206, however, arm 105 is spring biased to lower position 208. Switch body 104 contains contacts (not shown) that open or close as arm 105 changes from upper position 206 to lower position 208. With switch body 204's contacts closed, an electrical circuit may be completed in printer 100's control circuitry. With switch body 204's contacts open, any electrical circuit that includes the contacts will be broken. The change in state from open to closed or closed to open provides a signal to printer 100's control circuitry of the absence of paper 106 or the open position of cover 102. In a preferred embodiment, switch 104 is mechanical, with voltages contacts that open and close as a result of the position of arm 105. In an alternative embodiment, switch 104 may be a proximity switch, with voltages that increase and decrease according to the position of the switch adjacent to or removed from another physical object.

The configuration of the contacts as open or closed with arm 105 in upper position, and whether the contacts change from open to closed or closed to open when arm 105 moves to lower position 208 is a function of the specific control circuitry of printer 100. In one embodiment of the invention, the contacts of switch 104 would be "normally open," meaning the contacts are closed with arm 105 in upper position 206 and open when arm is in lower position 208.

With cover 102 in the closed position, arm 105 extends from switch body 104 to gap 114. Because arm 105 is spring biased to lower position 208, arm 105 tends to enter gap 114 if gap 114 is uncovered. Paper 106 in paper path 108 covers gap 114, however, preventing arm 105 from entering gap 114. Accordingly, with no paper 106 present in paper path 108, arm 105 moves to its lower position 208 as arm 105 enters gap 114, opening or closing the contact in switch 104 accordingly and providing a signal to selectively enable logic circuits (not illustrated herein) of printer 100. In the normally open configuration set forth above, an electrical circuit including switch 104 will be broken in the absence of paper 106.

Switch 104 is connected to cover 102. With paper 106 in paper path 108, arm 105 is held in upper position 206. If cover 102 is opened, however, switch 104 follows cover 102, allowing arm 105 to move to lower position 208 regardless if paper 106 is present in paper path 108 or not. Accordingly, when cover 102 is opened, arm 105 moves from upper position 206 to lower position 208 and switches the contact of switch 104 from open to closed or closed to open. In the normally open configuration set forth above, an electrical circuit including switch 104 will be broken when cover 102 is opened.

Therefore, it is apparent that one switch 104 is capable of providing a signal to printer 100's logic circuits that either (1) paper 106 is missing or (2) cover 102 is open. Printers that are designed to be stopped when paper runs out or if the cover is opened will therefore have a lower manufacturing cost, as one switch can be used to perform two functions.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. For example, one alternative embodiment of the invention would include a proximity switch that would change state upon the absence of paper or if the switch was moved away from paper if the cover of the printer, to which the switch was attached, was opened. It is therefore contemplated that the appended claims will cover any such modifications or embodiments that fall within the true scope of the invention.

What is claimed is:

1. A printer for printing characters on a paper, comprising:

a switch and means mounting said switch such that said switch is held in a first position by the paper and by a closed cover of the printer, said switch moves to a second position in the absence of the paper or as the cover of the printer is opened.

2. The printer of claim 1, wherein the switch is mounted to the cover of the printer.

3. The printer of claim 2, wherein the switch further comprises an arm.

4. The printer of claim 3, further comprising a paper path within the printer and a gap along the paper path, wherein the arm of the switch moves into the gap in the absence of the paper.

5. The printer of claim 1, further comprising a print head for printing characters on the paper, a drive means for moving the print head across the paper and a control circuit for controlling the motion of the print head.

6. The printer of claim 5, wherein the switch is coupled to the control circuit and, when the switch is in the second position, provides a signal thereto, and wherein the control circuit stops the motion of the print head in response to the signal.

7. The printer of claim 5, wherein the switch is coupled to the control circuit, and in the absence of paper or upon opening the printer cover, provides a signal thereto, and wherein the control circuit stops the printing of the print head in response to the signal.

8. A printer for printing characters on a paper, comprising:

a case having a portion capable of being opened;

a movable print head;

a paper tray for receiving a supply of papers;

a control circuit for controlling the motion of the print head; and a sensor for providing a signal to the control circuit to stop the motion of the print head when the paper supply is exhausted or when the case is in a first position and a second signal to the control circuit to permit the motion of the print head when the paper supply contains paper or when the case is in a second position, wherein the sensor is operable for providing said signal in an absence of a light signal reflected from a surface of said paper.

9. The printer of claim 8, wherein the portion is hingedly attached to the case, allowing the portion to swing between a first position and a second position, wherein the first position is an open position and the second position is a closed position.

10. The printer of claim 9, wherein the case has an outside and an inside and the portion of the case has an underside, wherein the underside of the portion is inside the case and the sensor is attached to the underside of the portion.

11. The printer of claim 8, further comprising a platen, wherein the print head and the platen define a paper path along which paper travels as characters are printed thereupon.

12. The printer of claim 11, wherein the sensor is located adjacent the paper path.

13. The printer of claim 12, wherein the sensor further comprises an arm extending into the paper path for detection of the presence of paper along the paper path.

14. The printer of claim 13, wherein the sensor is coupled to the control circuit, the sensor providing a first signal when paper is present in the paper path and the portion of the case is in a closed position.

15. The printer of claim 14, wherein the sensor is coupled to the control circuit, the sensor providing a second signal when either paper is absent from the paper path or the portion of the case is in an open position.

16. The printer of claim 8, wherein the sensor is a mechanical switch.

17. The printer of claim 8, wherein the sensor is a proximity switch.

18. A method of controlling a printer, comprising the steps of:

providing a printer comprising a body with a cover, a sensor, a print head and a paper path;

selectively closing the cover;

inserting paper into the paper path until the paper is detected by the sensor;

moving the print head relative to the paper to print characters upon the paper;

stopping the print head when paper is no longer detected by the sensor or when the cover is opened; and starting the print head when paper is detected by the sensor and when the cover is closed, the paper detection not in response to a light signal reflected from a surface of the paper.

19. The method of claim 18, wherein the sensor is a mechanical switch.

20. The method of claim 19, wherein the mechanical switch further comprises an arm extending adjacent the paper path, wherein the arm assumes a first position when paper is present in the paper path and a second position when paper is absent from the paper path.

21. The method of claim 20, wherein the sensor is attached to an underside of the cover and the arm assumes the second position when the cover is opened.

22. The method of claim 18, wherein the sensor is a proximity switch.

* * * * *